United States Patent [19]

Giori

[11] 4,056,056

[45] Nov. 1, 1977

[54] ROTARY PRINTING PRESS

[75] Inventor: Gualtiero Giori, Lonay, Switzerland

[73] Assignee: De La Rue Giori S.A., Switzerland

[21] Appl. No.: 643,532

[22] Filed: Dec. 19, 1975

Related U.S. Application Data

[63] Continuation-in-part of Ser. No. 452,385, March 18, 1974, abandoned.

[30] Foreign Application Priority Data

Mar. 21, 1973 Switzerland ..... 4082/73

[51] Int. Cl.[2] ..... B41F 9/02; B41F 11/00

[52] U.S. Cl. ..... 101/152; 101/175; 101/177; 101/183; 101/416 A

[58] Field of Search ..... 101/152, 153, 154, 175, 101/176, 177, 183, 184, 185

[56] References Cited

U.S. PATENT DOCUMENTS

| | | | |
|---|---|---|---|
| 709,515 | 9/1902 | Scott | 101/231 X |
| 958,661 | 5/1910 | Meisel | 101/181 |
| 1,065,228 | 6/1913 | Elsworth | 101/137 |
| 2,659,305 | 11/1953 | Giori | 101/155 X |
| 2,733,656 | 2/1956 | Gottsching | 101/175 |
| 3,007,406 | 11/1961 | Papa et al. | 101/183 |
| 3,158,092 | 11/1964 | Barthel | 101/183 X |
| 3,303,779 | 2/1967 | Giori | 101/152 |
| 3,384,011 | 5/1968 | Bolza-Schunemann | 101/177 |
| 3,486,444 | 12/1969 | Huck | 101/152 |
| 3,583,316 | 6/1971 | Bolza-Schunemann | 101/152 |
| 3,691,948 | 9/1972 | Southam | 101/183 |

FOREIGN PATENT DOCUMENTS

| | | | |
|---|---|---|---|
| 504,639 | 7/1954 | Canada | 101/229 |
| 480,175 | 12/1969 | Switzerland | 101/183 |

*Primary Examiner*—J. Reed Fisher

*Attorney, Agent, or Firm*—Robert E. Burns; Emmanuel J. Lobato; Bruce L. Adams

[57] ABSTRACT

A combined rotary printing press comprises an offset printer and a direct plate printer arranged in tandem. The offset printer comprises a transfer cylinder, a plurality of plate cylinders for applying an image to the transfer cylinder and an impression cylinder. The direct plate printer comprises a plate cylinder, inking means and a further impression cylinder. Paper handling means comprises a conveyor drum for feeding paper to the transfer cylinder in proper registration and means for conveying paper from the transfer cylinder of the offset printer to the impression cylinder of the direct plate printer. The impression cylinders of the offset printer and the direct plate printer are adjustable independently of one another and independently of the paper handling means so that each can be independently adjusted to provide the pressure desired without disturbing the paper registration.

8 Claims, 3 Drawing Figures

1
2
3
4
4a
4b
4c
5
5a
6
6a
7
7a
8
8a
9
10
11
12
13
14
14a
14b
15
16
16a
16b
17
17a
17b
18
18a
18b
18c
18d
19
19a
19b
19c
20
21
22
23
24
25
26
27
28
29
30
31
32
33
34
35
40

ROTARY PRINTING PRESS

This application is a continuation-in-part of my copending application, Ser. No. 452,385 filed Mar. 18, 1974, now abandoned.

The invention relates to a rotary printing press with at least two printing units, in particular multicolour printing units arranged in tandem, and through which paper to be printed passes in the form of sheets or webs in one operating sequence. The first printing unit is an indirect printing unit used, for example, for producing a background and including a resilient transfer cylinder adapted to be inked and the second printing unit being an engraving printing unit used, for example, for producing a main pattern and including a plate cylinder adapted to be inked by at least one stencil roller, which plate cylinder cooperates with an impression cylinder.

In such known rotary printing presses, a common impression cylinder is provided for both printing units, which cylinder cooperates both with the resilient transfer cylinder of the indirect printing unit and with the plate cylinder of the indirect printing unit which provides direct steel plate engraving printing. With this arrangement the paper to be printed is supplied to the common impression cylinder at a point located in front of the transfer cylinder, received in its direction or rotation, which bears against the impression cylinder. It is then guided by the latter firstly past the transfer cylinder and then the plate cylinder, the indirect and direct printing taking place in succession. It is then removed from the impression cylinder and conveyed to a delivery device. In particular, it is known to construct the first printing unit as an engraving printing unit printing indirectly, in which the ink pattern is transferred to the transfer cylinder by a plate cylinder inked by several stencil rollers.

It is also known to construct the first printing unit as an offset printing unit, in which two transfer cylinders, which are each linked by an offset plate cylinder supporting a partial coloured shape, cooperate with the common impression cylinder, which simultaneously serves as an impression cylinder for a photogravure unit. the provision of a common impression cylinder for two imprinting units operating according to different methods, is also found in known rotary printing presses. In this case the impression cylinder firstly cooperates with a letterpress plate cylinder and secondly with the plate cylinder of an engraved printing unit. Therefore, with this printing press, intended particularly for banknotes, the protective background is produced by letterpress printing and the main pattern by engraved printing within one operating sequence.

All known rotary printing presses with only one impression cylinder, which is associated with two different printing units and which carries along part of its periphery, the paper to be printed have the drawback that the contact pressures of the impression cylinder against the transfer cylinder, on the one hand, and the plate cylinder of the engraving printing unit, on the other hand, cannot be adjusted independently of each other. In fact, the contact pressure between the plate cylinder in an engraving printing unit must be substantially greater than the contact pressure between the transfer cylinder, in particular of an offset printing unit, and the impression cylinder cooperating with this transfer cylinder. Furthermore, since the impression cylinder common to the two different printing units serves as a support for the paper to be printed, which must pass through the printing press in registration, an adjustment of this impression cylinder with respect to the registration to be maintained, involves difficulties.

However, it is desirable and advantageous to print bills and banknotes with both a multicoloured protective background and a mutlicoloured main pattern in a combined rotary printing press as aforesaid with one passage of the paper.

It is an object of the present invention to construct a rotary printing press such that the contact pressures required for optimum indirect printing and for optimum direct engraving printing and in which the paper is respectively pressed against the transfer cylinder or against the plate cylinder, may be easily adjusted and this adjustment has no effect on the passage of the paper through the machine and thus on the registration to be maintained.

According to the present invention, there is provided a rotary printing press, comprising at least two printing units arranged in tandem and through which paper or other sheet material to be printed passes in the form of individual sheets or continuous webs in one operating sequence, the first printing unit being an indirect pring unit including a resilient transfer cylinder adapted to be inked, and the second printing unit being an engraving printing unit including a plate cylinder adapted to be inked by at least one stencil roller, which plate cylinder cooperates with an impression cylinder, and the first printing unit also having an impression cylinder, whereof the contact pressure is adjustable independently of that of the impression cylinder of the engraved printing unit, and there being a feed device for supplying the paper to the transfer cylinder independently of the first impression cylinder and between the two printing units, a conveyor device adapted to pick up the paper after it has passed the first impression cylinder and convey it in register to the impression cylinder of the engraved printing unit.

Preferably, the first printing unit is a multicolour offset printing unit, in which the transfer cylinder rolls on several offset plate cylinders each supporting a partial coloured shape. However, the first printing unit may also be formed as a multicolour letterpress unit, the rubber cylinder then cooperating with several letterpress plate cylinders each supporting a corresponding partial colour shape.

Appropriately, the diameters of the transfer cylinder, the second impression cylinder, and the plate cylinder of the engraved printing unit are sufficiently large that several, for example three equal printing surfaces or plate areas can be provided on its periphery, the first impression cylinder, which is preferably a steel cylinder, cooperating with the transfer cylinder having a smaller diameter than the transfer cylinder. Thus, in the case where three equal printing surfaces are provided on the transfer cylinder, the diameter of the first impression cylinder amounts to only one-third of the diameter of the transfer cylinder. In this way, a compartively great peripheral region of the transfer cylinder is available for the location of a correspondingly large number of plate cylinders with their inking devices. Thus, four different plate cylinders with their ink plates may be easily located in the first printing unit, so that the indirect printing takes place in four colours, whereas the second printing unit may advantageously be a three-colour printing unit.

Since each printing unit has its own impression cylinder, both impression cylinders may be adjusted completely independently of each other, as regards optimum contact pressure, without the adjustment of one impression cylinder affecting that of the other. Furthermore, since the paper supplied to the printing press is supplied directly to the transfer cylinder in advance of the impression cylinder, the impression cylinder of the first printing unit can have no effect on the supply of paper in registration.

If both printing units are intended to print the same side of the paper, then the conveyor device between the two printing units preferably consists of two conveyor drums of equal size, the first of which takes the paper from the transfer cylinder, the printed side of the paper then being located externally and being subjected to the action of an ink-drying and paper-moistening device, whereas the second conveyor drum takes the paper from the first, turns it and conveys it to the second impression cylinder of the engraved printing unit, on which the printed side of the paper is now located externally. Advantageously, the diameter of the two conveyor drums is less than the common diameter of the transfer cylinder, of the second impression cylinder and of the plate cylinder and amounts, for example, when three equal printing surfaces are provided on the transfer cylinder, to two-thirds of the diameter of the transfer cylinder, so that each conveyor drum has two sheet feed surfaces in the case of printing sheets.

In order to provide two sides of the paper with a background and a main pattern respectively, two similarly constructed rotary printing presses according to the invention may be arranged in tandem, so that both sides of the paper are printed accordingly in one operating sequence.

Two embodiments of the invention are described, by way of example, with reference to the drawings, in which.

Figure 1:
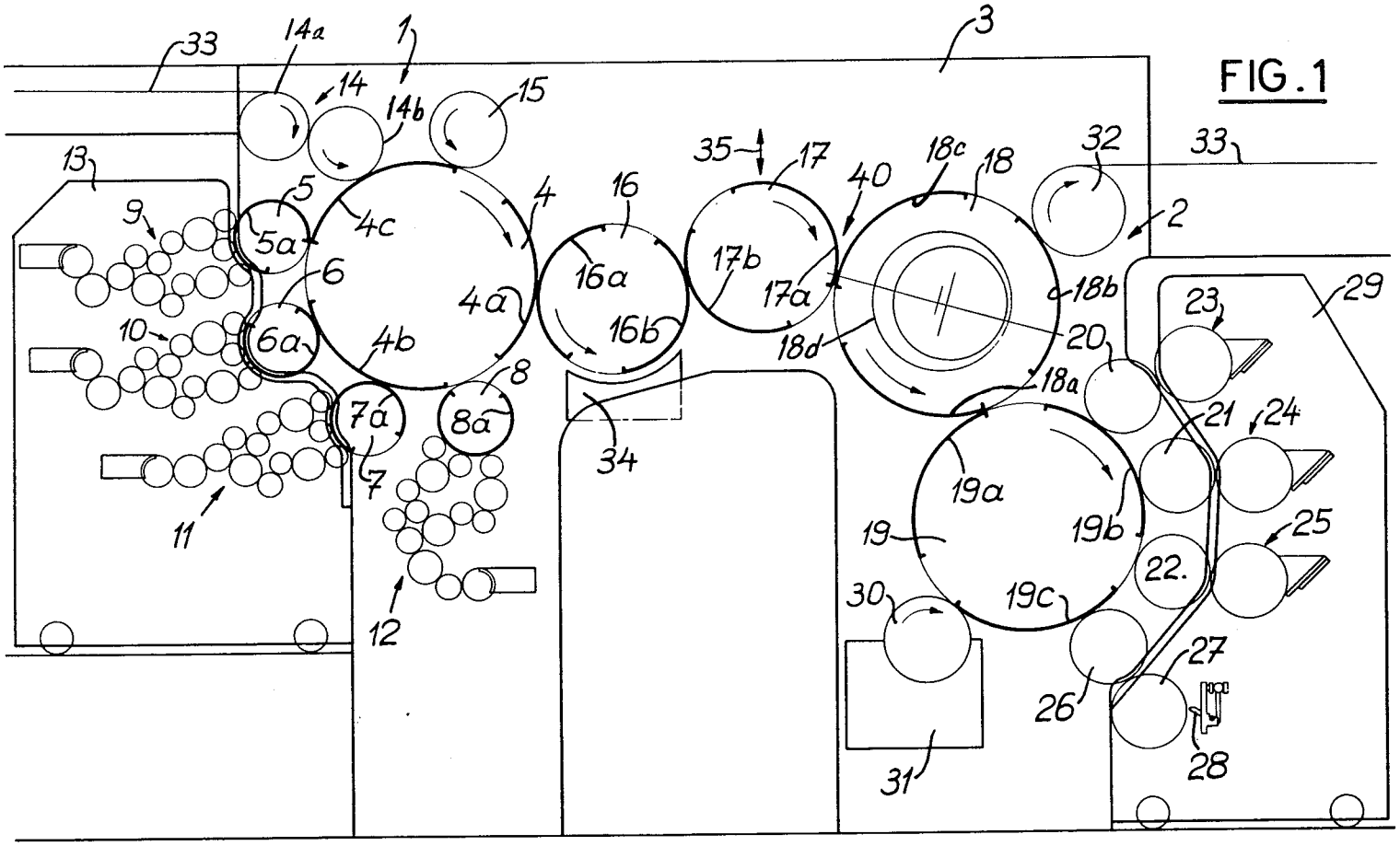
FIG. 1 is a diagrammatic view of a first embodiment of a rotary printing press according to the invention and FIG. 2 is a partial view of a second embodiment of a rotary printing press.

In the embodiment according to FIG. 1, there is a dry offset printing unit 1 comprising a transfer or "blanket" cylinder shown as a rubber cylinder 4, four plate cylinders 5, 6, 7 and 8 axially parallel to and cooperating with the rubber cylinder, each of which plate cylinders being inked by conventional inking devices 9, 10, 11 and 12, a paper feed device 14 which supplies the paper 33 to be printed to the rubber cylinder 4 and a steel impression cylinder 15. The paper feed device 14 is shown as comprising a drum 14*a* which, in the case of printing sheets, is a conventional stop drum as shown for example in Bolza-Schuneman U.S. Pat. No. 3,384,001 and a conveyor drum 14*b* which delivers the paper to the rubber cylinder 4.

There is also another printing unit 2 which is a steel plate engraving printing unit comprising an impression cylinder 18, a plate cylinder 19 axially parallel to and cooperating with the impression cylinder, three stencil or partial inking rollers 20, 21 and 22 inked by inking devices 23, 24, 25, and ink regulating cylinder 26, a wiper cylinder 30 and a discharge drum 32 removing the printed paper 33 from the impression cylinder 18. The ink regulating cylinder 26 removes excess ink from the plate cylinder 19 and transfers it to a further cylinder 27, from which it is removed by a doctor blade 28 for the purpose of recovery. The wiper cylinder 30, which cleans the surface of the engraved steel printing plates on the plate cylinder 19 outside the engraved cavities, is immersed in a container 31 filled with a cleaning fluid.

Located between the rubber cylinder 4 of the dry offset printing unit 1 and the impression cylinder 18 of the engraving printing unit 2 is a conveyor device consisting of two conveyor drums 16 and 17. The device accepts the paper 33 printed in the dry offset printing unit 1 from the rubber cylinder 4 and conveys it to the impression cylinder 18. The directions of rotation of all cylinders and drums are illustrated by arrows in FIG. 1.

The inking devices 9, 10 and 11 of the printing unit 1 are mounted in a frame 13 which can be removed from a main frame 3 of the machine, whereas the inking devices 23, 24 and 25 as well as the cylinder 27 cooperating with the ink regulating cylinder 26 are located in a frame 29, which may likewise be removed from the main frame 3. All the remaining parts of the machine are mounted in the main frame 3 including, for reasons of space in the embodiment considered, the inking device 12 of the printing unit 1. However, the device 12 may be mounted in a frame which can be likewise withdrawn from the main frame 3.

The rubber cylinder 4, the impression cylinder 18 and the steel engraving plate cylinder 19 all have the same diameter, and the curved surface of each of these cylinders has three printing surfaces of equal area symmetrically arranged thereon, each area being that of a sheet of paper to be printed. Thus, three printing surfaces 4*a*, 4*b* and 4*c* are provided on the rubber cylinder 4, which surfaces are respectively inked one after the other with different inks by the four offset plate cylinders 5 to 8 during the rotation of the rubber cylinder. Each of the plate cylinders 5 to 8 supports a partial coloured shape, 5*a*, 6*a*, 7*a* and 8*a* respectively, which is inked by the inking devices 9, 10, 11 and 12 respectively and whose partial images are transferred to the printing plates of the rubber cylinder 4 and are combined to form the entire printed image. Therefore, on passing the impression cylinder 15, the paper 33 is provided with a four-colour offset print, three sheets being printed with a four-colour offset print for each full revolution of the rubber cylinder 4.

The plate cylinder 19 of the engraved printing unit 2 supports three engraved printing plates 19*a*, 19*b* and 19*c*, which intermittently cooperate with three corresponding printing surfaces 18*a*, 18*b* and 18*c* of the impression cylinder 18. The stencil or partial inking rollers 20, 21 and 22 are each inked with one ink and transfer the inks to the respective regions of the engraved portions of the printing plates, whose surfaces are then cleaned by the ink regulating cylinder 26 and wiper cylinder 30, the inks being simultaneously forced into the engraved cavities. When a sheet of paper 33 is guided under pressure between the plate cylinder 19 and the impression cylinder 18, the inks are transferred from the engraved cavities to the paper, three sheets being provided with a three-ink engraved print for each full revolution of the plate cylinder 19 or impression cylinder 18.

Thus, one side of the paper is firstly provided with a four-colour offset print and then with a three-colour engraved print. When printing bills, in particular banknotes, the offset printing forms the safety background and the engraved printing the main pattern.

Each of the conveyor drums 16 and 17 has two contact surfaces 16*a* and 16*b* or 17*a* and 17*b* on its periphery. The diameter of these conveyor drums is two-thirds that of the cylinder 4, whereas the diameter of the impression cylinder 15, the offset plate cylinders 5 to 8 as well as the stencil rollers 20 to 22 equals one-third of the diameter of the rubber cylinder 4. The axes of the shafts of the conveyor drums 16 and 17, which axes are stationary when sheets are being printed, are offset relative to a straight line connecting the axes of the rubber cylinder 4 and the impression cylinder 18. Therefore, the respectively cooperating printing or contact surfaces, namely, according to FIG. 1, the printing surface 4*a* of the rubber cylinder 4 and the contact surface 16*a* of the conveyor drum 16, the two contact surfaces 16*b* and 17*b* of the two conveyor drums 16 and 17, the contact surface 17*a* of the conveyor drum 17 and the printing surface 18*c* of the impression cylinder 18 and the printing surface 18*a* of the impression cylinder 18 and the printing plate 19*a* of the plate cylinder 19 engage one another with a time-lag. This means that the time at which the leading edge of a sheet on the rubber cylinder 4 is transferred by grippers (not shown) to the conveyor drum 16, the time at which a sheet on the conveyor drum 16 is transferred by grippers to the conveyor drum 17, and the time at which a sheet is transferred by grippers from the conveyor drum 17 to the impression cylinder 18, are staggered with respect to one another. Likewise the beginning of pressing of a sheet between the printing plate 19*a* of the plate cylinder 19 and the printing surface 18*a* of the impression cylinder 18 is staggered in time with respect to the aforementioned points of time.

On the conveyor drum 16, the side of the paper which has been printed in the printing unit 1 is on the outside, whereas the conveyor drum 17 picks up the paper and conveys it to the impression cylinder 18 so that the printed side of the paper is again on the outside. Provided along the periphery of the conveyor drum 16 is a known device 34, by which the ink on the paper is dried and the paper is moistened.

Since each of the two printing units 1 and 2 has its own impression cylinder 15 and 18, each of the impression cylinders may be adjusted as regards its optimum contact pressure independently of the other, the necessary contact pressure in the engraving printing unit 2 being greater than that in the offset printing unit 1. Furthermore, since the feed device 14 which, in the case of printing sheets, supplies the sheets coming from a sheet feed to the rubber cylinder 4, is independent of the impression cylinder 15, then adjustment of the impression cylinder 15 in no way affects the registration of the sheets fed to the rubber cylinder 4. The conveyor drum 14*b* and rubber cylinder 4 in conventional manner are provided with suitable grippers as known for example through Mowry U.S. Pat. Nos. 3,606,308 and 3,637,202. Adjustment of the contact pressure of the impression cylinder 18 is obtained in known manner by an eccentric 18*d* on which the cylinder 18 is mounted. The eccentric is so arranged that in regulating the contact pressure against the plate cylinder 19, the impression cylinder 18 effects approximately a small swinging movement about a (fictive) axis which is parallel to the axis of rotation of the impression cylinder and passes through a transfer point 40 between the conveyor drum 17 and the impression cylinder 18. In this way, the sheet is fed to the impression cylinder 18 in such manner that registration is maintained and is not impaired when the impression cylinder is adjusted. The discharge drum 32 is mounted with sufficient clearance or if required, is movably mounted to permit adjustment of the impression cylinder.

The conveyor device between the two printing units 1 and 2 may also consist of a known chain gripper system if, as in the embodiment described according to FIG. 1, the same side of the paper is intended to be printed in both printing units. With such a system two endless conveyor chains with suitable grippers can be provided in known manner in place of the conveyor drums 16 and 17, one conveyor chain picking up the sheet from the rubber cylinder 4 with its printed side on the outside and, whilst turning the sheet, discharging it to the other conveyor chain. From the latter, the sheet passes to the impression cylinder 18, with its printed side on the outside.

The rotary printing press may also be constructed for printing a paper web as well as paper sheets. In this case, the conveyor drum 17 is displaceably mounted with its shaft movable in a direction at right angles to a straight line connecting the axes of the rubber cylinder 4 and the impression cylinder 18, as indicated by the double arrow 35. During printing, particularly during printing in the engraving printing unit 2, increased tension occurring in the paper web may be compensated for or kept approximately constant by displacement of the conveyor drum 17. This increased tension in the paper web during the application of great pressure on the paper in the engraving printing unit 2, is compensated for by adjusting by an appropriate displacement the conveyor drum 17.

Figure 2:
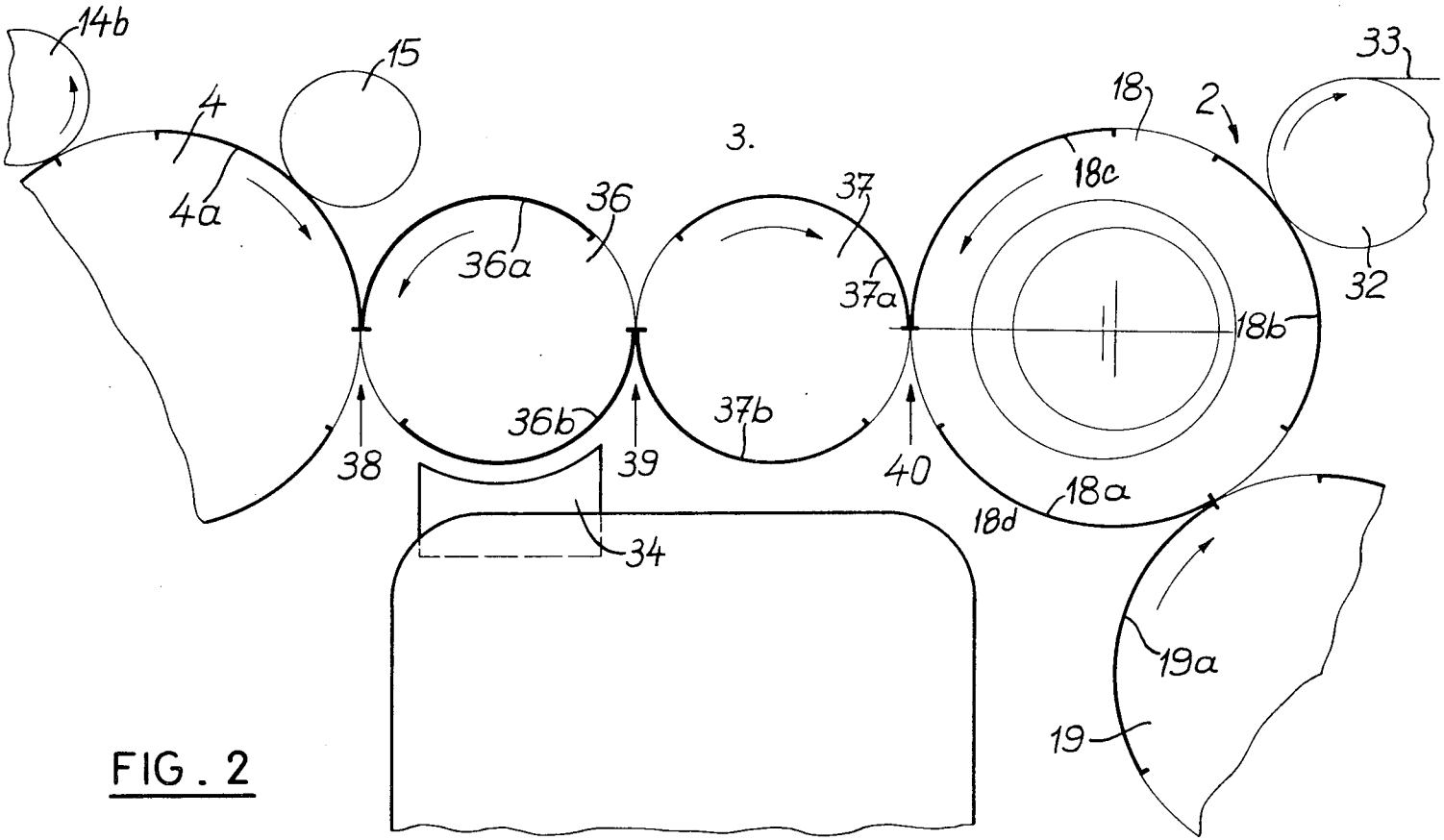

The embodiment of a rotary printing press shown in FIG. 2, once more comprises an offset printing unit 1 and an engraved printing unit 2, the printing unit 1 comprising a rubber cylinder 4 cooperating with plate cylinders not shown, an impression cylinder 15 and a sheet feed device 14, and the second printing unit 2 comprising a plate cylinder 19 cooperating with stencil rollers which are not shown and wiper devices, an impression cylinder 18 as well as a sheet discharge device 33. The difference between this embodiment and that of FIG. 1 is that the shafts of the conveyor drums 36 and 37 mounted in the main frame are located substantially on a straight line connecting the axes of the rubber cylinder 4 and the impression cylinder 18. Therefore, the respectively cooperating printing surfaces or contact surfaces or printing plates, namely the printing surface 4*a* of the rubber cylinder 4 and the contact surface 36*a* of the drum 36, the contact surfaces 36*b* and 37*b* of the drums 36 and 37, the contact surface 37*a* of the drum 37 and the printing surface 18*c* of the impression cylinder 18 and finally the engraved printing plate 19*a* on the plate cylinder 19 and the printing surface 18*a* of the impression cylinder 18 roll simultaneously against each other. The beginning of a printing operation between a printing plate of the plate cylinder 19 and a printing surface of the impression cylinder 18 thus coincides with the beginning of the transfer of a sheet to the drums 36 and 37 or to the impression cylinder 18. Thus, the beginning of pressing a sheet coincides with the time when sheets are picked up by the gripper systems of the drums 36 and 37 or impression cylinder 18 for the purpose of transfer. Thus, all the effects brought about by these momentary operations, coincide and have no mutually disturbing effects, which could impair the retention of registration in particular.

The conveyor device between the two printing units 1 and 2 may also contain a sheet or web turning device such that indirect printing in the printing unit 1 takes place on one side of the paper and engraved printing in the printing unit 2 takes place on the other side. Suitable sheet turning devices are known through Giori Swiss pat. Nos. 480,175 and Schunermann U.S. Pat. No. 2,896,535. Web turning can be effected in known manner by turning bars which twist or turn the web 180° as it passes between two spaced conveyor drums.

In addition, the printing unit 1 may also be a letterpress unit, the rubber cylinder 4 then cooperating with a letterpress plate cylinder or with several plate cylinders supporting partial letterpress ink shapes. The printing unit 1 may also be an engraving printing unit printing indirectly, the rubber cylinder 4 then cooperating with the plate cylinder inked by at least one stencil roller.

When two of the described rotary printing presses each with two printing units 1 and 2 are arranged in tandem one behind the other, then the sheets or webs passing therethrough may each be provided firstly on the one and then on the other side with indirect printing and direct engraved printing in one operation.

Figure 3:
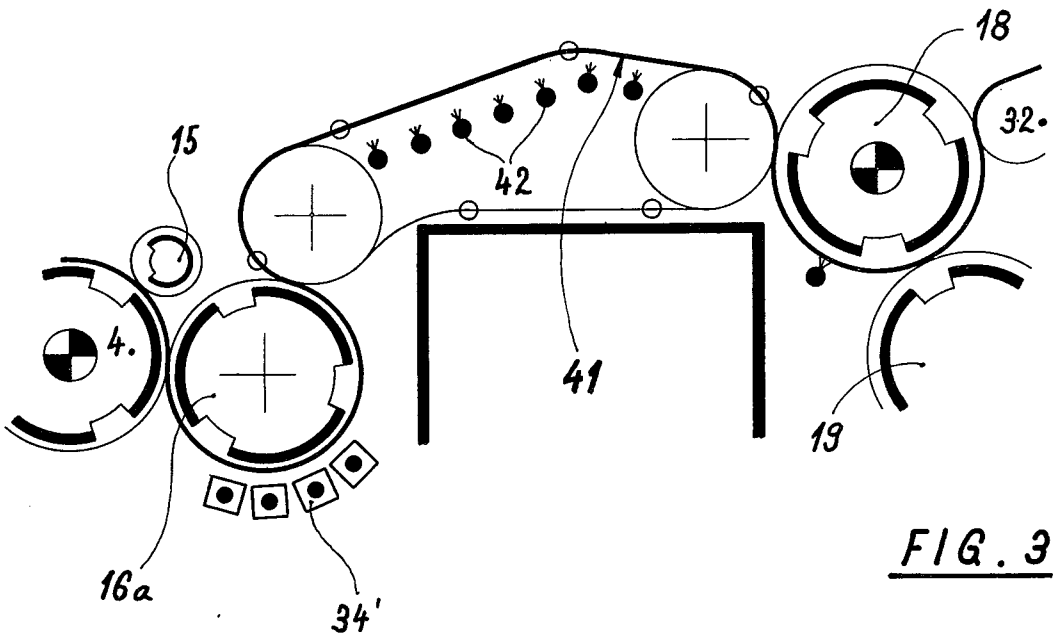
FIG. 3 is a diagrammatic view showing a modification.

A further modification of the rotary printing press shown in FIG. 1 is illustrated schematically in FIG. 3. The only differences between the press of FIG. 1 and that of FIG. 3 are as follows. The second conveyor drum 17 of FIG. 1 is replaced by a registration chain 41. This is better from a constructional point of view, particularly with regard to the driving mechanism of the cylinders and also offers the possibility of continuing the drying of the side of the sheet that has just been printed by drying means 42 under the chain. The first conveyor drum 16', corresponding to drum 16 in FIG. 1, has the same diameter as the rubber cylinder 4. Drying means 34' under the conveyor drum 16' corresponds to drying means 34 of FIG. 1. Adjustment of contact pressure between the impression cylinder 18 and the plate cylinder 19 can be effected in the same manner as in the press of FIG. 1.

What I claim and desired to secure by Letters Patent is:

1. A combined rotary printing press for printing on sheet material, said press comprising an offset printer and a direct plate printer arranged in tandem, said offset printer comprising a blanket cylinder, a plate cylinder cooperating with said blanket cylinder to apply an image thereto and a first impression cylinder comprising a steel cylinder for pressing said sheet material against said blanket cylinder to transfer said image to said sheet material, said direct plate printer comprising a plate cylinder, inking means for applying ink to a plate on said plate cylinder and a second impression cylinder for pressing said sheet material against a plate cylinder to print said sheet material, said first and second impression cylinders being independently adjustable to provide optimum contact pressure, feed means comprising a first conveyor drum for feeding said sheet material to said blanket cylinder of said offset printer at a position in advance of and spaced from said first impression cylinder in proper registration with said image on said blanket cylinder, and transfer means comprising a second conveyor drum for transferring said sheet material from said offset printer to said direct plate printer, said first and second conveyor drums being spaced from and independent of said first impression cylinder, whereby said first impression cylinder is adjustable to obtain optimum contact pressure without disturbing registration of said sheet material with said image on said blanket cylinder.

2. A combined rotary press according to claim 1, in which said blanket cylinder, said second impression cylinder and the plate cylinder of said direct plate printer are of like diameter, each of said cylinders having a plurality of printing areas.

3. A combined rotary press according to claim 1, in which said first impression cylinder is of smaller diameter than said blanket cylinder.

4. A combined rotary press according to claim 1, in which said transfer means comprises said second conveyor drum and a third conveyor drum of like diameter, said second conveyor drum taking sheets from said blanket cylinder and delivering them to said third conveyor drum and said third conveyor drum receiving sheets from said second conveyor drum and delivering them to said second impression cylinder.

5. A combined rotary press according to claim 4, in which the axes of rotation of said conveyor drum lie substantially in a plane defined by the axis of said blanket cylinder and the axis of said second impression cylinder.

6. A combined rotary press according to claim 4, in which the axes of rotation of said conveyor drums are located respectively on opposite sides of a plane defined by the axis of said blanket cylinder and the axis of said second impression cylinder.

7. A combined rotary press according to claim 4, in which said conveyor drums are of smaller diameter than said blanket cylinder.

8. A combined rotary press according to claim 7, in which the diameter of said conveyor drums is approximately two thirds that of said blanket cylinder.

* * * * *